US009089166B1

(12) United States Patent
Scatterday

(10) Patent No.: US 9,089,166 B1
(45) Date of Patent: Jul. 28, 2015

(54) PACKAGING FOR VAPORIZING DEVICE

(71) Applicant: NJOY, Inc., Scottsdale, AZ (US)

(72) Inventor: Mark Scatterday, Scottsdale, AZ (US)

(73) Assignee: NJOY, Inc., Scottsdale, AZ (US)

( * ) Notice: Subject to any disclaimer, the term of this patent is extended or adjusted under 35 U.S.C. 154(b) by 30 days.

(21) Appl. No.: 14/274,396

(22) Filed: May 9, 2014

(51) Int. Cl.

| | |
|---|---|
| ***A24F 15/12*** | (2006.01) |
| ***A24F 47/00*** | (2006.01) |
| ***A24F 15/00*** | (2006.01) |
| *B65D 85/10* | (2006.01) |

(52) U.S. Cl.
CPC ..... *A24F 15/12* (2013.01); *A24F 15/00* (2013.01); *A24F 47/002* (2013.01); *B65D 85/10* (2013.01); *B65D 85/1063* (2013.01)

(58) Field of Classification Search
CPC ..... A24F 13/02; A24F 13/14; A24F 15/00; A24F 15/02; A24F 15/10; A24F 15/12; A24F 15/14; A24F 15/16; A24F 15/18; B65D 85/10; B65D 85/1045; B65D 85/1063; B65D 85/1072; B65D 85/1081
USPC ..... 131/231, 238, 240.1, 242, 250; 206/38, 206/236, 242, 246, 249–251, 256, 264–268, 206/271, 273, 276; 220/500–501, 503, 220/523–524, 528–529, 533; 229/120.04, 229/120.06, 120.08, 120.38, 160.1
See application file for complete search history.

(56) References Cited

U.S. PATENT DOCUMENTS

| | | | | |
|---|---|---|---|---|
| 374,584 | A | | 12/1887 | Cook |
| 576,653 | A | | 2/1897 | Bowlby |
| 595,070 | A | | 12/1897 | Oldenbusch |
| 799,844 | A | * | 9/1905 | Fuller ..... 206/134 |
| 969,076 | A | | 8/1910 | Pender |
| 1,067,531 | A | | 7/1913 | MacGregor |
| 1,163,183 | A | | 12/1915 | Stoll |
| 1,299,162 | A | | 4/1919 | Fisher |
| 1,505,748 | A | | 3/1924 | Tamis |
| 1,552,877 | A | | 9/1925 | Phillipps et al. |
| 1,632,335 | A | | 6/1927 | Hiering |
| 1,706,244 | A | | 3/1929 | Meyerson |
| 1,815,069 | A | * | 7/1931 | Petro ..... 220/345.1 |
| 1,845,340 | A | | 2/1932 | Ritz |
| 1,972,118 | A | | 9/1934 | McDill |
| 1,998,683 | A | | 4/1935 | Montgomery |

(Continued)

FOREIGN PATENT DOCUMENTS

| | | | | |
|---|---|---|---|---|
| CN | 201290340 | Y | * | 8/2009 |
| CN | 101869356 | A | | 10/2010 |

(Continued)

OTHER PUBLICATIONS

English abstract of JP 2001-165437 A (1 page).

(Continued)

*Primary Examiner* — Bryon Gehman
*Assistant Examiner* — Brijesh V. Patel
(74) *Attorney, Agent, or Firm* — Bookoff McAndrews, PLLC

(57) ABSTRACT

A package for electronic vaporizing devices and components thereof may include a base and a cover coupled to the base for opening and closing the package. The package may include one or more guiding elements providing for a plurality of slots of different lengths, e.g., for receiving various components of the electronic vaporizing device. The package may include a slot or compartment for housing a power adapter and/or replacement components of the electronic vaporizing device.

17 Claims, 5 Drawing Sheets

(56) References Cited

U.S. PATENT DOCUMENTS

| | | | | |
|---|---|---|---|---|
| 2,031,363 | A | 2/1936 | Erikson | |
| 2,039,559 | A | 5/1936 | Segal | |
| 2,327,120 | A | 11/1940 | McCoon | |
| 2,231,909 | A | 2/1941 | Hempel | |
| 2,460,427 | A | 2/1949 | Musselman et al. | |
| 2,483,304 | A | 9/1949 | Vogel | |
| 2,502,561 | A | 4/1950 | Ebert | |
| 2,765,949 | A | 10/1956 | Hillman | |
| 2,897,958 | A | 8/1959 | Tarleton | |
| 3,142,385 | A * | 7/1964 | Kahlenberg | 211/74 |
| 3,146,937 | A | 9/1964 | Vesak | |
| 3,420,360 | A | 1/1969 | Young | |
| 3,567,014 | A | 3/1971 | Feigelman | |
| 3,861,523 | A * | 1/1975 | Fountain et al. | 206/236 |
| 3,941,300 | A | 3/1976 | Troth | |
| 4,000,812 | A * | 1/1977 | Pisarski et al. | 206/87 |
| 4,207,976 | A | 6/1980 | Herman | |
| 4,519,319 | A | 5/1985 | Howlett | |
| 4,736,838 | A * | 4/1988 | Nakata et al. | 206/762 |
| 4,771,796 | A | 9/1988 | Myer | |
| 4,798,310 | A | 1/1989 | Kasai et al. | |
| 4,813,536 | A | 3/1989 | Willis | |
| 4,848,563 | A | 7/1989 | Robbins | |
| 5,005,759 | A | 4/1991 | Bouche | |
| 5,074,412 | A * | 12/1991 | White | 206/256 |
| 5,123,530 | A | 6/1992 | Lee | |
| 5,269,327 | A | 12/1993 | Counts et al. | |
| 5,368,155 | A * | 11/1994 | Ewen | 206/86 |
| 5,465,738 | A * | 11/1995 | Rowland | 131/329 |
| 5,566,855 | A * | 10/1996 | Bradach | 221/15 |
| 5,605,226 | A | 2/1997 | Hernlein | |
| 5,641,064 | A | 6/1997 | Goserud | |
| 5,746,587 | A | 5/1998 | Racine et al. | |
| 5,810,164 | A | 9/1998 | Rennecamp | |
| 5,848,596 | A * | 12/1998 | Zelenik | 206/244 |
| 5,881,884 | A | 3/1999 | Podosek | |
| 5,938,018 | A | 8/1999 | Keaveney et al. | |
| 5,967,310 | A | 10/1999 | Hill | |
| 5,975,415 | A | 11/1999 | Zehnal | |
| 5,979,460 | A | 11/1999 | Matsumura | |
| 6,125,082 | A * | 9/2000 | Reid | 368/10 |
| 6,260,701 | B1 * | 7/2001 | Katayama et al. | 206/379 |
| 6,269,966 | B1 | 8/2001 | Pallo et al. | |
| 6,349,827 | B1 * | 2/2002 | Feder | 206/373 |
| 6,386,371 | B1 | 5/2002 | Parsons | |
| 6,431,363 | B1 | 8/2002 | Hacker | |
| 6,446,793 | B1 * | 9/2002 | Layshock | 206/86 |
| 6,474,342 | B1 * | 11/2002 | Rennecamp | 131/241 |
| 6,510,982 | B2 | 1/2003 | White et al. | |
| 6,557,708 | B2 | 5/2003 | Polacco | |
| 6,622,867 | B2 | 9/2003 | Menceles | |
| 6,672,762 | B1 | 1/2004 | Faircloth | |
| 6,726,006 | B1 | 4/2004 | Funderburk et al. | |
| 7,000,775 | B2 | 2/2006 | Gelardi | |
| 7,374,048 | B2 | 5/2008 | Mazurek | |
| 7,419,320 | B2 * | 9/2008 | LaBrasca | 206/443 |
| 7,546,703 | B2 | 6/2009 | Johnske et al. | |
| 7,621,403 | B2 | 11/2009 | Althoff et al. | |
| 7,644,823 | B2 | 1/2010 | Gelardi et al. | |
| 7,815,332 | B1 | 10/2010 | Smith | |
| 7,886,507 | B2 | 2/2011 | McGuinness, Jr. | |
| 7,988,034 | B2 | 8/2011 | Pezzoli | |
| 8,141,701 | B2 | 3/2012 | Hodges | |
| 8,443,534 | B2 | 5/2013 | Goodfellow et al. | |
| 8,464,867 | B2 | 6/2013 | Holloway et al. | |
| 8,539,959 | B1 | 9/2013 | Scatterday | |
| 8,596,460 | B2 | 12/2013 | Scatterday | |
| 2001/0032795 | A1 | 10/2001 | Weinstein et al. | |
| 2001/0052480 | A1 | 12/2001 | Kawaguchi et al. | |
| 2002/0043554 | A1 | 4/2002 | White et al. | |
| 2002/0175164 | A1 | 11/2002 | Dees et al. | |
| 2003/0063523 | A1 * | 4/2003 | Mulaw | 368/10 |
| 2003/0089377 | A1 | 5/2003 | Hajaligol et al. | |
| 2003/0178328 | A1 * | 9/2003 | Williamson | 206/204 |
| 2004/0149624 | A1 | 8/2004 | Wischusen, III et al. | |
| 2004/0216753 | A1 * | 11/2004 | Fox | 131/242 |
| 2005/0061759 | A1 | 3/2005 | Doucette | |
| 2005/0118545 | A1 * | 6/2005 | Wong | 431/146 |
| 2005/0145533 | A1 | 7/2005 | Seligson | |
| 2005/0172976 | A1 | 8/2005 | Newman et al. | |
| 2005/0236282 | A1 * | 10/2005 | Huska | 206/246 |
| 2006/0054676 | A1 | 3/2006 | Wischusen, III | |
| 2006/0150991 | A1 | 7/2006 | Lee | |
| 2006/0254948 | A1 | 11/2006 | Herbert et al. | |
| 2006/0255105 | A1 | 11/2006 | Sweet | |
| 2006/0289319 | A1 * | 12/2006 | Lin | 206/315.1 |
| 2007/0098148 | A1 | 5/2007 | Sherman | |
| 2007/0235046 | A1 | 10/2007 | Gedevanishvili | |
| 2007/0267033 | A1 | 11/2007 | Mishra et al. | |
| 2008/0092912 | A1 | 4/2008 | Robinson et al. | |
| 2008/0276947 | A1 | 11/2008 | Martzel | |
| 2009/0095311 | A1 | 4/2009 | Han | |
| 2009/0267252 | A1 | 10/2009 | Ikeyama | |
| 2009/0288669 | A1 | 11/2009 | Hutchens | |
| 2010/0000672 | A1 | 1/2010 | Fogle | |
| 2010/0031968 | A1 | 2/2010 | Sheikh et al. | |
| 2010/0186757 | A1 | 7/2010 | Crooks et al. | |
| 2010/0200006 | A1 | 8/2010 | Robinson et al. | |
| 2010/0242974 | A1 | 9/2010 | Pan | |
| 2010/0276333 | A1 | 11/2010 | Couture | |
| 2010/0307116 | A1 | 12/2010 | Fisher | |
| 2011/0049226 | A1 | 3/2011 | Moreau et al. | |
| 2011/0068026 | A1 * | 3/2011 | Fakhouri et al. | 206/244 |
| 2011/0155153 | A1 | 6/2011 | Thorens et al. | |
| 2011/0162667 | A1 | 7/2011 | Burke et al. | |
| 2011/0168194 | A1 | 7/2011 | Hon | |
| 2011/0180433 | A1 * | 7/2011 | Rennecamp | 206/268 |
| 2011/0232654 | A1 | 9/2011 | Mass | |
| 2011/0240494 | A1 * | 10/2011 | Vecchi | 206/273 |
| 2011/0265806 | A1 | 11/2011 | Alarcon et al. | |
| 2011/0278189 | A1 | 11/2011 | Terry et al. | |
| 2011/0315701 | A1 | 12/2011 | Everson | |
| 2012/0060853 | A1 | 3/2012 | Robinson et al. | |
| 2012/0204889 | A1 | 8/2012 | Xiu | |
| 2012/0227753 | A1 * | 9/2012 | Newton | 131/347 |
| 2012/0261286 | A1 | 10/2012 | Holloway et al. | |
| 2012/0267383 | A1 | 10/2012 | Van Rooyen | |
| 2013/0140200 | A1 | 6/2013 | Scatterday | |
| 2013/0228191 | A1 | 9/2013 | Newton | |
| 2013/0247924 | A1 | 9/2013 | Scatterday et al. | |
| 2013/0248385 | A1 | 9/2013 | Scatterday et al. | |
| 2013/0276802 | A1 | 10/2013 | Scatterday | |
| 2013/0284190 | A1 | 10/2013 | Scatterday et al. | |
| 2013/0284191 | A1 | 10/2013 | Scatterday et al. | |
| 2013/0341218 | A1 * | 12/2013 | Liu | 206/242 |
| 2014/0053858 | A1 | 2/2014 | Liu | |
| 2014/0196731 | A1 | 7/2014 | Scatterday | |
| 2014/0374289 | A1 | 12/2014 | Liu | |

FOREIGN PATENT DOCUMENTS

| | | | |
|---|---|---|---|
| CN | 203318894 | U | 12/2013 |
| EP | 2325093 | A1 | 5/2011 |
| JP | 2001-165437 | A | 6/2001 |
| WO | WO-2011/033396 | A1 | 3/2011 |
| WO | WO-2011/117580 | A2 | 9/2011 |
| WO | WO-2012/021972 | A1 | 2/2012 |
| WO | WO 2013/141906 | | 9/2013 |
| WO | WO 2013/141907 | | 9/2013 |
| WO | WO 2013/141994 | | 9/2013 |
| WO | WO 2013/141998 | | 9/2013 |
| WO | WO 2013/142671 | | 9/2013 |
| WO | WO 2013/142678 | | 9/2013 |
| WO | WO 2014/113592 | | 7/2014 |

OTHER PUBLICATIONS

Invitation to Pay Additional Fees and, Where Applicable, Protest Fee, mailed on May 13, 2015, in International PCT Application No. PCT/US2015/010124 (6 pages).

* cited by examiner

PACKAGING FOR VAPORIZING DEVICE

TECHNICAL FIELD

The present disclosure generally relates to packaging for vaporizers, including, but not limited to, portable electronic vaporizers, such as, e.g., electronic cigarettes, cigars, pipes, hookahs, and other vaporizing devices. More particularly, embodiments of the present disclosure include portable packaging such as cases and containers for carrying components of electronic vaporizing devices.

BACKGROUND

Electronic cigarettes, electronic cigars, and other vaporizing or vaping devices provide an alternative to traditional smoking devices that can offer many benefits to users. These devices may be intended for single-use or limited use (e.g., disposable devices), or may be designed for multiple use or extended use (e.g., rechargeable devices) with recharging or replacement of various components, such as a cartridge and/or a battery. Portable devices that have multiple components may be inconvenient to carry.

BRIEF SUMMARY

The present disclosure includes a package comprising: a base; a cover movably coupled to the base for opening and closing the package; and a first guiding element disposed within the base and extending along only a portion of a length of the base; wherein the base includes a plurality of slots at least partially extending through the first guiding element for receiving a plurality of components of an electronic vaporizing device, at least one of the slots having a length different from a length of another one of the slots. Embodiments of the present disclosure may include one or more of the following features: the base may include at least one slot extending a substantially entire length of the base; the first guiding element may be coupled to an upper portion of the base; the first guiding element may include at least three slots, at least two of the slots having the same length; the first guiding element may include five slots; the package may comprise a second guiding element configured to receive at least one end portion of a component of the electronic vaporizing device; the second guiding element may be coupled to a lower portion of the first guiding element; the second guiding element may be configured to seal an opening in the component of the electronic vaporizing device; the second guiding element may be coupled to a bottom portion of the base; the package may comprise the plurality of components of the electronic vaporizing device; the plurality of components may include at least one of a battery unit and a cartridge unit; the package may comprise a compartment at least partially separated from the plurality of slots; and/or the compartment may include a power adapter.

The present disclosure further includes a package comprising: a base; a cover pivotally attached to the base for opening and closing the package; a first guiding element disposed within the base and extending along only a portion of a length of the base; and at least one electronic cigarette; wherein the base includes a plurality of slots at least partially extending through the first guiding element, the plurality of slots comprising a first slot including the electronic cigarette and a second slot having a length different from a length of the first slot. Embodiments of the present disclosure may include one or more of the following features: the package may comprise at least one replacement component of the electronic cigarette disposed in the second slot; and/or the at least one replacement components may include a cartridge unit.

The present disclosure further includes a package comprising: a base including a bottom wall and an open top, wherein the bottom wall includes a door; and a cover pivotally attached to the base for opening and closing the package; wherein the base includes a plurality of slots for receiving a plurality of components of an electronic vaporizing device, the plurality of slots including a first slot open to the cover and closed to the bottom wall of the base, and the second slot being open to the door of the bottom wall of the base and closed to the cover. Embodiments of the present disclosure may include one or more of the following features: the package may comprise at least one guiding element, the first slot at least partially extending through the at least one guiding element; the second slot may comprise a compartment adjacent to the first slot; and/or the first slot may extend from the bottom wall to the open top.

It is understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate exemplary embodiments of the present disclosure and together with the description, serve to explain the principles of the disclosure.

DETAILED DESCRIPTION

Figure 1:
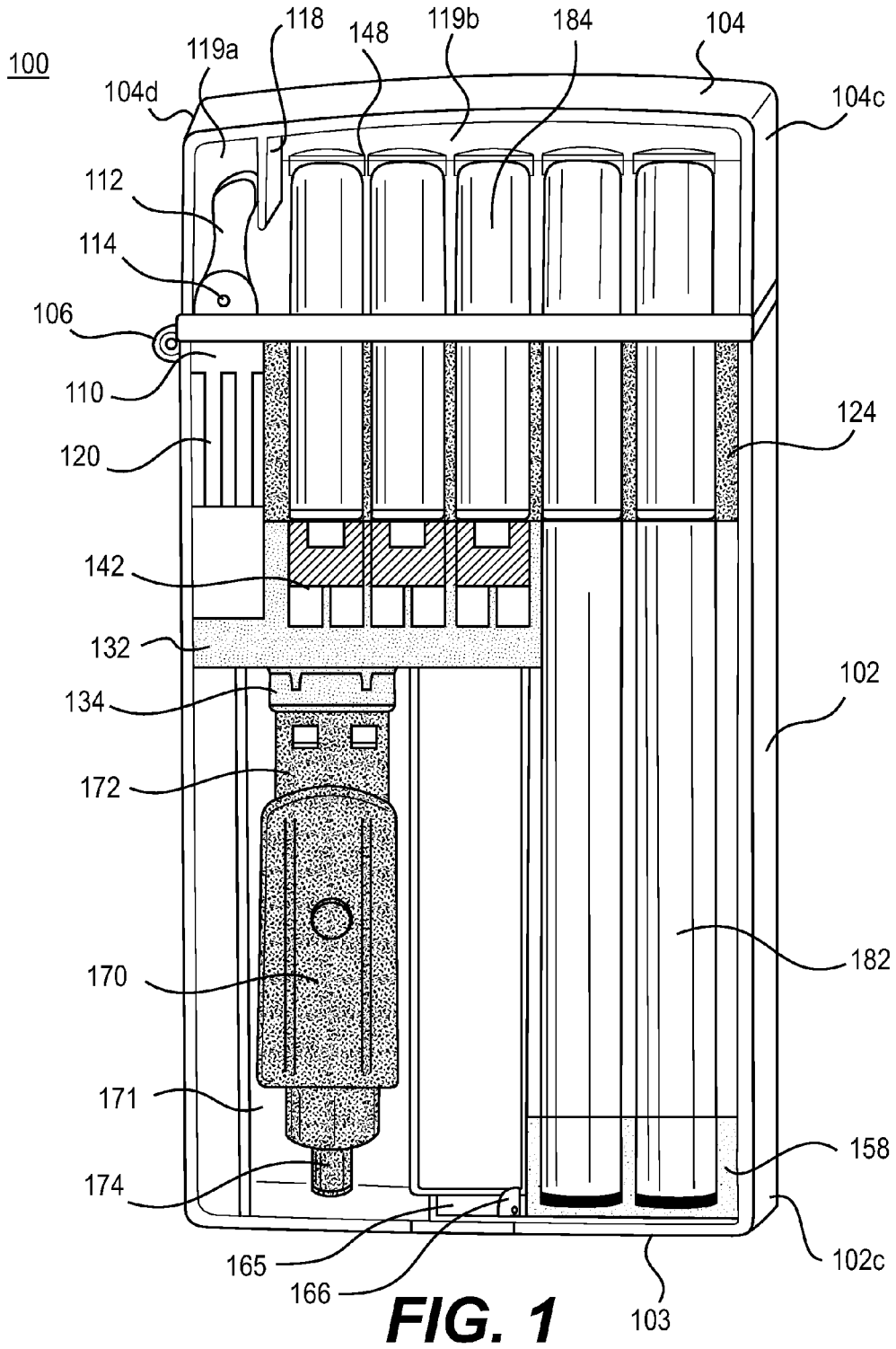
FIG. 1 shows an exemplary package in a closed configuration, in accordance with one or more embodiments of the present disclosure.

Particular aspects of the present disclosure are described in greater detail below. The terms and definitions as used and clarified herein are intended to represent the meaning within the present disclosure. The patent literature referred to herein is hereby incorporated by reference. The terms and definitions provided herein control, if in conflict with terms and/or definitions incorporated by reference.

The singular forms "a," "an," and "the" include plural reference unless the context dictates otherwise.

Embodiments of the present disclosure include packaging for components of an electronic vaporizing device, such as components of a rechargeable electronic cigarette, e.g., one or more cartridge units and one or more battery units. In some embodiments, the package may be configured to house a power source or power adapter for recharging the vaporizing device.

Various aspects of the present disclosure may be used with and/or include one or more of the features or configurations disclosed in U.S. application Ser. No. 13/495,186, filed Jun. 13, 2012, and published as US 2013/0248385, entitled "Electronic Cigarette Container"; U.S. application Ser. No. 13/954,593, filed Jul. 30, 2013, and published as US 2013/0313139, entitled "Electronic Cigarette Container"; U.S. Application No. 29/440,716, filed Dec. 26, 2012, entitled "Electronic Cigarette Container"; U.S. application Ser. No. 13/744,176, filed Jan. 17, 2013, and issued as U.S. Pat. No. 8,794,245, entitled "Aroma Pack for an Electronic Cigarette"; U.S. Provisional Application No. 61/891,626, filed Oct. 16, 2013, entitled "Portable Vaporizer Packaging"; U.S. application Ser. No. 13/490,352, filed Jun. 6, 2012, now U.S. Pat. No. 8,695,794, entitled "Electronic Cigarette Container and Method Therefor"; U.S. application Ser. No. 13/729,396, filed Dec. 28, 2012, and issued as U.S. Pat. No. 8,539,959, entitled "Electronic Cigarette Configured to Simulate the Natural Burn of a Traditional Cigarette"; U.S. application Ser. No. 13/627,715, filed Sep. 26, 2012, entitled "Electronic Cigarette Configured to Simulate the Natural Burn of a Traditional Cigarette"; U.S. application Ser. No. 13/974,845, filed Aug. 23, 2013, and published as US 2013/0333712 A1, entitled "Electronic Cigarette Configured to Simulate the Natural Burn of a Traditional Cigarette"; U.S. application Ser. No. 13/741,109, filed Jan. 14, 2013, and published as US 2013/0284190 A1, entitled "Electronic Cigarette Having a Paper Label"; U.S. application Ser. No. 13/744,092, filed Jan. 17, 2013, and published as US 2013/0284191 A1, entitled "Electronic Cigarette Having a Flexible and Soft Configuration"; U.S. application Ser. No. 13/744,812, filed Jan. 18, 2013, and published as US 2013/0276802 A1, entitled "Electronic Cigarette Configured to Simulate the Filter of a Traditional Cigarette"; U.S. application Ser. No. 13/707,378, filed Dec. 6, 2012, and issued as U.S. Pat. No. 8,596,460, entitled "Combination Box and Display Unit"; U.S. Provisional Application No. 61/826,318, filed May 22, 2013, entitled "Compositions, Devices, and Methods for Nicotine Aerosol Delivery"; U.S. Provisional Application No. 61/856,374, filed Jul. 19, 2013, entitled "Compositions, Devices, and Methods for Nicotine Aerosol Delivery"; U.S. Provisional Application No. 61/918,480, filed Dec. 19, 2013, entitled "Vaporizing Device with Multicolor Light"; U.S. Provisional Application No. 61/906,795, filed Nov. 20, 2013, entitled "Electronic Cigarette Having Multiple Air Passages"; U.S. Provisional Application No. 61/906,803, filed Nov. 20, 2013, entitled "Leak Prevention Device for an Electronic Cigarette"; U.S. Provisional Application No. 61/906,810, filed Nov. 20, 2013, entitled "Packaging Assembly"; U.S. Provisional Application No. 61/907,002, filed Nov. 21, 2013, entitled "Electronic Cigarette and Method of Assembly Therefor"; U.S. Provisional Application No. 61/907,003, filed Nov. 21, 2013, entitled "Flexible and Stretchable Electronics for an Electronic Cigarette"; and/or U.S. Provisional Application No. 61/847,364, filed Jul. 17, 2013, entitled "Wireless Communication System for an Electronic Cigarette"; the disclosures of each of which are incorporated by reference herein in their entireties.

Exemplary packages 100 and 200 are shown in FIGS. 1-4 and 5, respectively, to illustrate various components and features of the present disclosure. It is understood that the present disclosure is not limited to those examples, and that other shapes, configurations, dimensions, and/or combinations of features are encompassed by the present disclosure, as further discussed below.

Base and Cover

Figure 2:
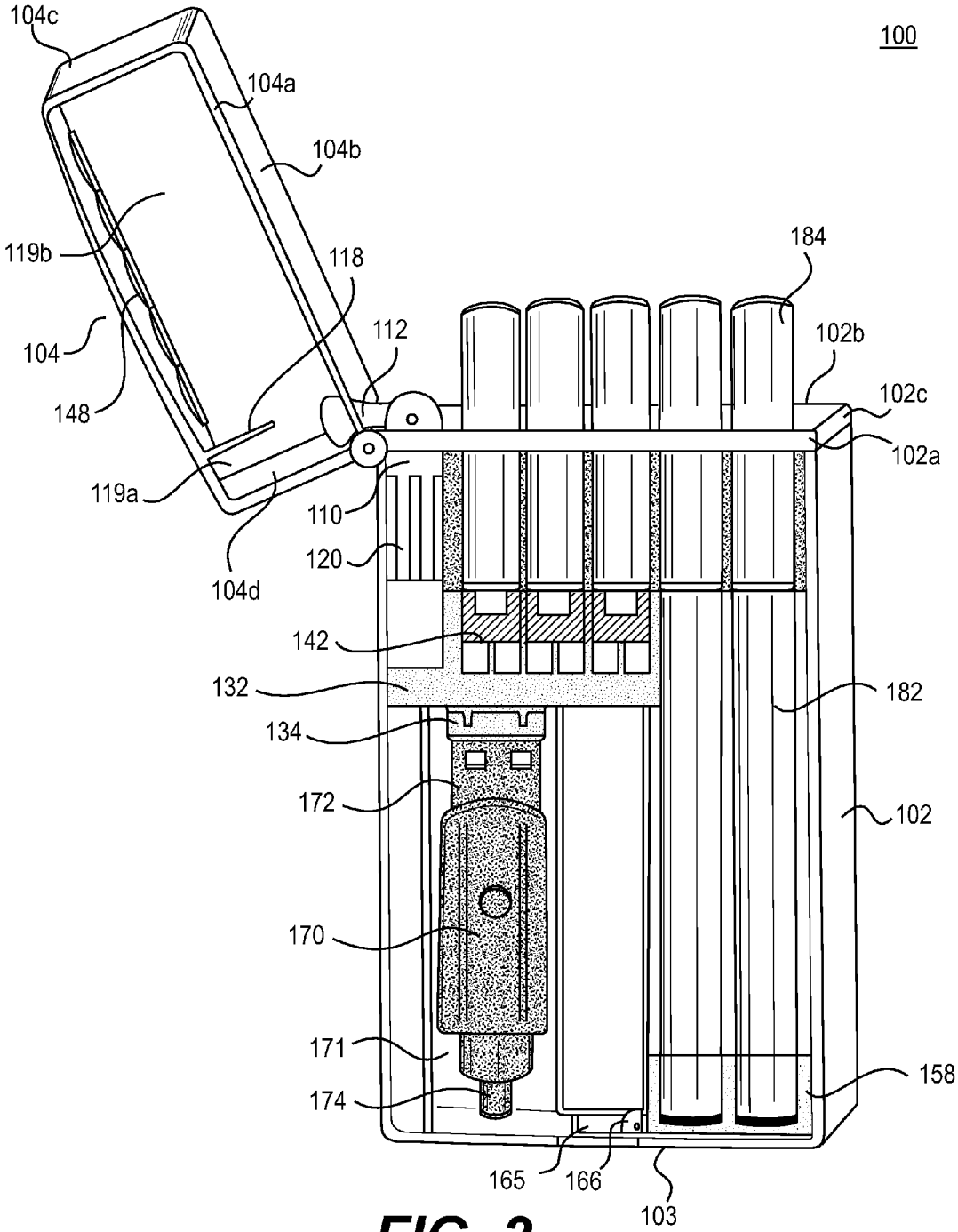
FIG. 2 shows an exemplary package in an opened configuration, in accordance with one or more embodiments of the present disclosure.
Figure 3:
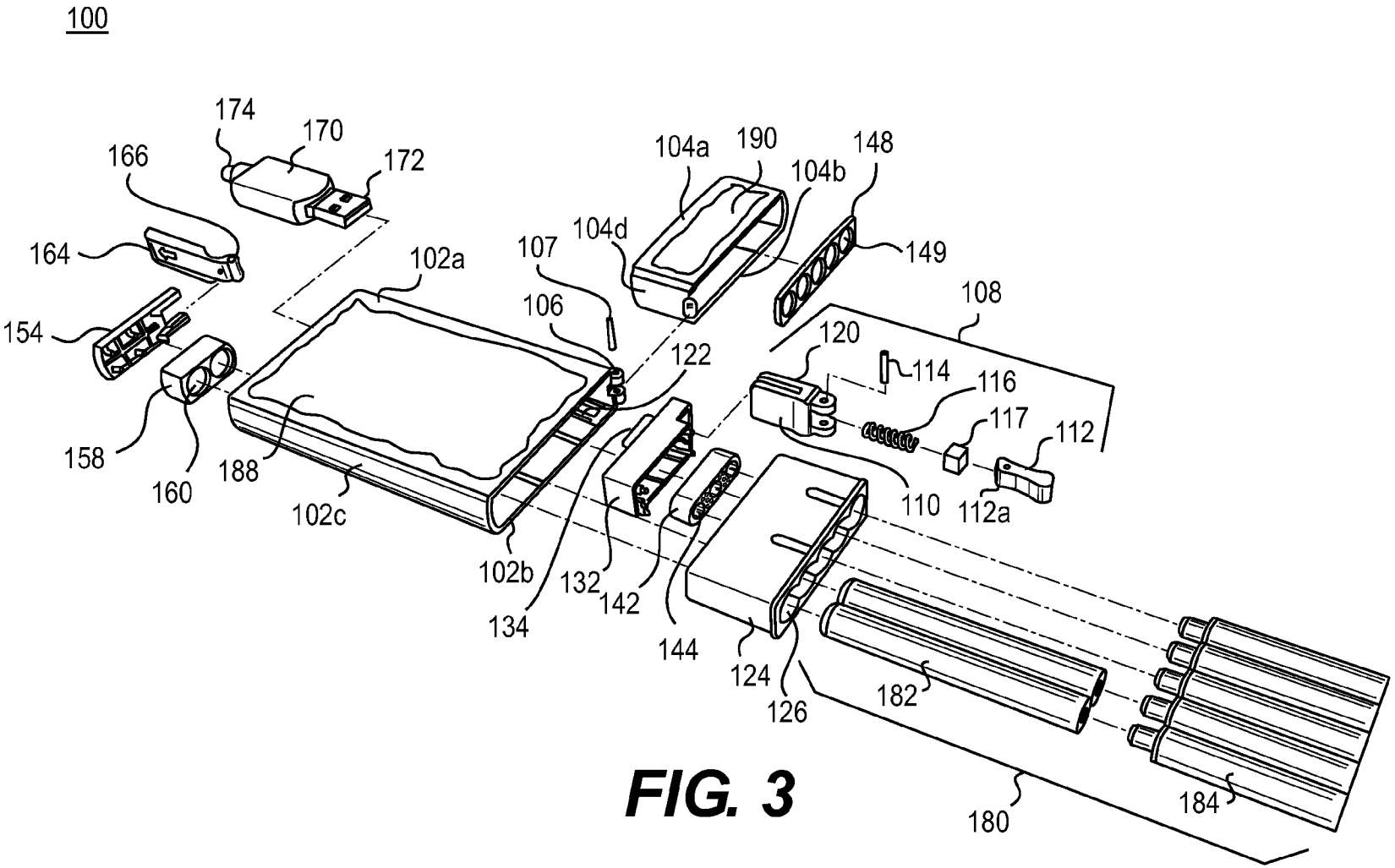
FIG. 3 shows an exploded view of an exemplary package, in accordance with one or more embodiments of the present disclosure.

An exemplary package 100 is shown in FIGS. 1-4, including a base 102 and a cover 104, the combined lengths of the base 102 and cover 104 defining the total length of package 100. That is, the length dimension is along the long axis of an electronic cigarette 180 within package 100. The base 102 may include a front wall 102*a*, a back wall 102*b*, a first side wall 102*c*, a second side wall 102*d*, and a closed bottom 103, such that each of the front and back walls 102*a*, 102*b* defines the width of package 100 (the width dimension being perpendicular to the length dimension and extending from the first side to the second side of package 100), and each of the side walls 102*c*, 102*d* defines the depth of package 100 (the depth dimension being perpendicular to the length dimension and extending from the front to the back of package 100). While package 100 is shown as generally rectangular in shape, packages according to the present disclosure may have any other suitable shape, configuration, and/or dimensions. In some embodiments, the front wall 102*a* may have generally the same shape and dimensions as the back wall 102*b*. Similarly, the first side wall 102*c* may have generally the same shape and dimensions as the second side wall 102*d*. In some embodiments, the walls may have different shapes or dimensions. In at least one embodiment, for example, one side wall may be substantially flat (e.g., second side wall 102*d*), while the other side wall 102*c* may be curved (e.g., first side wall 102*c*). For example, the first side wall 102*c* may have a substantially concave inner surface and substantially convex outer surface or vice versa. The walls of the base 102 (e.g., walls 102*a*, 102*b*, 102*c*, and 102*d*) may be connected via suitable rounded or otherwise beveled edges or chamfer. In some embodiments, the bottom 103 of the base 102 may include a door 164 as shown in FIGS. 3 and 4A-4B (not explicitly shown in FIGS. 1 and 2), as discussed further below.

Similar to the base 102, the cover 104 may include a front wall 104*a*, a back wall 104*b*, a first side wall 104*c*, and a second side wall 104*d*, such that each of the front and back walls 104*a*, 104*b* defines the width of the package 100, and each of the side walls 104*c*, 104*d* defines the depth of the package 100. In some embodiments, the cover 104 may have a shape similar to the shape of the base 102, e.g., wherein the first side wall 104*c* may be curved and the second side wall 104*d* may be substantially flat. The walls of the cover 104 (e.g., walls 104*a*, 104*b*, 104*c*, and 104*d*) also may be connected via suitable rounded or otherwise beveled edges or chamfer.

The cover 104 may be coupled to the base 102 via any suitable connection or mechanism. In at least one embodiment, the cover 104 may be pivotally attached to the base 102. As shown in FIGS. 1-3, for example, the base 102 and the cover 104 may include complementary projections connected by a pin 107 extending therethrough to form a hinge 106, such that a longitudinal axis of the pin 107 defines a pivot axis about which the cover 104 pivots relative to the base 102. The cover 104 may be coupled to the base 102 along a side wall of the base 102 (e.g., the pivot axis extending in the depth dimension and along an uppermost edge of one of the side walls 102*c*, 102*d*), or may be coupled to the base 102 along the front wall 102*a* or the back wall 102*b* (e.g., the pivot axis extending in the width dimension and along an uppermost edge of the front wall 102*a* or the back wall 102*b*).

The base 102 and the cover 104 may comprise any suitable materials, including, but not limited to, plastic (e.g., molded plastic) and other polymers, metal, ceramic, or any combination thereof. The base 102 may comprise one or more different materials than the cover 104. In some embodiments, at least a portion of the base 102 and/or the cover 104 (or the entire base 102 and/or cover 104) may be transparent or translucent, e.g., such that contents of package 100 may be visible through the base 102 and/or the cover 104. In some embodiments, at least a portion of the base 102 and/or the cover 104 (or the entire base 102 and/or the entire cover 104) may be opaque.

Package 100 may include a hinge assembly 108 at least partially disposed within the base 102 for moving the cover 104 into different positions with respect to the base 102. Any features with respect to a hinge or hinge assembly disclosed in U.S. application Ser. No. 13/495,186, filed Jun. 13, 2012, and published as US 2013/0248385, entitled "Electronic Cigarette Container"; U.S. application Ser. No. 13/954,593, filed Jul. 30, 2013, and published as US 2013/0313139, entitled "Electronic Cigarette Container"; U.S. Application No. 29/440,716, filed Dec. 26, 2012, entitled "Electronic Cigarette Container"; U.S. application Ser. No. 13/744,176, filed Jan. 17, 2013, entitled "Aroma Pack for an Electronic Cigarette"; and/or U.S. Provisional Application No. 61/891,626, filed Oct. 16, 2013, entitled "Portable Vaporizer Packaging," each of which is incorporated by reference herein, may be used according to the present disclosure. In particular, the hinge assembly 108 may be used to close package 100 into a closed configuration (as shown in FIG. 1), and open package 100 into an opened configuration (as shown in FIG. 2), e.g., by rotating the cover 104 away from, and towards, the base 102.

The hinge assembly 108 may include any suitable component or mechanism to allow the cover 104 to move relative to the base 102. For example, the hinge assembly 108 may include a lower portion, e.g., segment 110, coupled to an upper portion, e.g., lever 112. In some embodiments, the segment 110 may be coupled to the lever 112 via a pin 114, such that a longitudinal axis of the pin 114 defines a pivot axis about which the lever 112 pivots relative to the segment 110. The segment 110 may be at least partially disposed in the base 102, and the lever 112 may be at least partially disposed in the cover 104. In some embodiments, the position of the segment 110 may be fixed with respect to the base 102 (e.g., the segment 110 fixedly attached to one or more walls of the base 102, such as the front wall 102*a*, the back wall 102*b*, and one of the side walls 102*c*, 102*d*), and the lever 112 may be movable into different positions with respect to the segment 110 and the cover 104. The lever 112 may pivot relative to the segment 110 such that, when package 100 is in the closed configuration, the lever 112 is closer to the top of the cover 104 than when package 100 is in the opened configuration. In some embodiments, the hinge assembly 108 may include a spring 116, e.g., disposed within the segment 110, wherein the tension of the spring 116 may be used to manipulate the cover 104 into different positions. For example, the segment 110 may include an element 117 between the spring 116 and the lever 112 as shown in FIG. 3. The spring 116 may be fixedly attached to the element 117, and the element 117 may bear against a bottom cam surface 112*a* of the lever 112 to move the lever 112 into different positions, thus moving the cover 104 into different positions as further described below.

The hinge assembly 108 may be coupled to the package 100 by any suitable mechanism and/or with any appropriate material(s). In some embodiments, the segment 110 may be fixedly attached to an inner surface of the package 100. For example, the segment 110 may be attached to the base 102 with a suitable adhesive material. In some embodiments, the segment 110 may include one or more features complementary with one or more features inside the base 102 to secure the segment 110 within the base 102. For example, the segment 110 may include one or more ridges 120 complementary to one or more channels 122 within the base 102, such that the channel(s) 122 may receive the ridge(s) 120 when the hinge assembly 108 is inserted into the base 102. In at least one embodiment, the segment 110 may include ridges 120 on opposite sides of the segment 110 complementary to channels 122 in the front wall 102*a* and the back wall 102*b* of the base 102. For example, the segment 110 may include two pairs of ridges 120 on opposite sides of the segment 110 (only one pair of ridges 120 being visible in FIGS. 1-3) that may be received within four channels 122 of the base 102, two channels 122 extending along inner surfaces of each of the front wall 102*a* and back wall 102*b* (only one pair of channels being visible in FIG. 3). In some embodiments, the segment 110 and/or the base 102 may include an adhesive to assist in securing the hinge assembly 108 to the base 102. Other features and/or mechanisms may be suitable for securing the hinge assembly 108 such as, e.g., one or more slots or tapered channels within the base 102 configured to receive the segment 110 or a portion thereof in a friction fit. In some embodiments, at least a portion of the segment 110 may be integral with the base 102.

The cover 104 may be configured to assist in maintaining package 100 in a closed configuration. For example, the cover 104 may have a shape, dimension, and/or configuration generally corresponding to the base 102 to form a friction fit or seal. In some embodiments, an inner surface of the cover 104 may include a stepped portion configured to matingly receive a stepped portion of the base 102 when the cover 104 is closed upon the base 102.

The cover 104 may include a scalloped or otherwise recessed area to provide clearance for receiving one or more items disposed within the base 102 as the cover 104 is opened and closed. In some embodiments, the cover 104 may include a medial wall 118 to at least partially partition the cover 104 into different sections. The medial wall 118 may include any suitable configuration known in the art. As shown in FIGS. 1 and 2, for example, the medial wall 118 may extend from the top of the cover 104 generally parallel to the side walls 104*c*, 104*d* to define a first section 119*a* for receiving the lever 112, and a second section 119*b* for receiving other items, such as portions of components of a vaporizing device. The lever 112 may engage the medial wall 118 and/or one or more walls of the cover 104 defining the first section 119*a* to open and close package 100. The lever 112 may have different positions. For example, when the cover 104 is closed as shown in FIG. 1, the lever 112 may be in an upright position (that is, the lever 112 may generally extend along a longitudinal axis of the segment 110) and may exert a force upon the medial wall 118 to maintain the cover 104 in the closed position. Further for example, when the cover 104 is open as shown in FIG. 2, the lever 112 may form an angle with the segment 110 (that is, the lever 112 may extend along an axis transverse to the longitudinal axis of the segment 110), and may exert a force upon an inner surface of the cover 104 (e.g., side wall 104*d*) to maintain the cover 104 in the opened position. The forces exerted by the lever 112 may be generated by the spring 116 disposed within the segment 110. For example, the spring 116 within the segment 110 may help to force the cover 104 open after the medial wall 118 moves the lever 112 a certain distance, and may help to force the cover 104 closed after the side wall 104*d* moves the lever 112 a certain distance.

In some embodiments, the second section 119*b* may include a fixture 148 configured to receive one or more components of a vaporizing device. Any of the features of a cover disclosed in U.S. Provisional Application No. 61/891,626, filed Oct. 16, 2013, incorporated by reference herein, may be used in the present disclosure. For example, the fixture 148 may be configured to create an airtight seal with the end of a vaporizing device intended to be placed into the mouth during use. As shown in FIG. 3, the fixture 148 may include features complementary to a plurality of cartridge units 184, e.g., to protect the cartridge units 184 from damage, contamination, and/or a loss of potency, e.g., by loss of material or upon exposure to air. For example, the fixture 148 may include a plurality of recessed surfaces 149 having a shape complementary to the ends of the cartridge units 184, e.g., circular or other suitable cross-sectional shape. At least a portion of the fixture 148, e.g., the recessed surfaces 149, may be flexible or deformable to conform to the shape of the ends of the cartridge units 184.

Guiding Elements

Package 100 may include one or more guiding elements for receiving and/or maintaining different components of a vaporizing device. The guiding element(s) may be configured to limit movement of the vaporizing device components when disposed within package 100. As shown in FIGS. 1-3, for example, the base 102 may include slots or spaces for one or more electronic cigarettes 180 (each electronic cigarette 180 comprising a battery unit 182 and a cartridge unit 184), and one or more cartridge units 184, e.g., to replace cartridge units 184 depleted over time with use of the electronic cigarette(s) 180. In some embodiments, package 100 may include a single row of slots, such that the depth of package 100 generally corresponds to the diameter of the electronic cigarettes 180 and cartridge units 184. Packages according to the present disclosure may be configured to house other items such as, e.g., mouthpieces, liquid refill containers, vaporization units or attachments, heating units or attachments, sensors or sensor attachments, and/or lights or lighting attachments, among other possible items.

In some embodiments, the base 102 may include a caddy 124 having a plurality of slots 126. While FIGS. 1-3 illustrate an example having five slots 126, the caddy 124 may have fewer or more than five slots 126 (e.g., 1, 2, 3, 4, 6, 7, 8, 9, or 10 or more). Each slot 126 may have a shape that generally matches the shape of a corresponding component. For example, one or more of the slots 126 may have a curvature for receiving a cylindrical component, e.g., a cartridge unit 184 and/or a battery unit 182 of the electronic cigarette 180. The slots 126 all may have the same shape, or one or more slots 126 may have a shape different than the shape of another slot 126. Further, the slots 126 may be completely or only partially separated from adjacent slots 126. In some embodiments, for example, each slot 126 may be only partially separated such that the slots 126 are in communication with each other. Each slot 126 may extend the entire length of the caddy 124 (as shown in FIGS. 1 and 2) or along only a portion of the caddy 124. While the caddy 124 as shown in FIGS. 1 and 2 is coupled to an upper portion of the base 102, the caddy 124 may be attached or otherwise coupled to any other suitable portion of the base 102. The caddy 124 may extend the entire length, width, and/or depth of package 100, or only a portion of the length, width, and/or depth of package 100. Embodiments of the present disclosure may include more than one caddy 124, e.g., coupled to different portions of the base 102, e.g., at different locations along the length of the base 102.

Additionally or alternatively, the base 102 may include one or more support elements for receiving an end portion of a component, such as the tip of a cartridge unit 184 and/or the tip of an electronic cigarette 180 (e.g., the tip of a battery unit 182 of the electronic cigarette 180). In some embodiments, the support element may be configured to form a friction fit or airtight seal around at least a portion of the component, e.g., to protect the component from damage, contamination, and/or a loss of potency, e.g., by loss of material or upon exposure to air. For example, at least a portion of the support element may be flexible or deformable, e.g., to conform to the shape of a component inserted therein. Any of the features used for receiving, protecting, covering, and/or maintaining components of vaporizing devices as disclosed in U.S. Provisional Application No. 61/891,626, filed Oct. 16, 2013, incorporated by reference herein, may be used in the present disclosure.

In some embodiments, the base 102 of package 100 may include a first support element 142 for receiving an end portion of one or more first components, e.g., tip portions of cartridge units 184, and/or a second support element 158 for receiving an end portion of one or more second components, e.g., tip portions of one or more battery units 182. Support elements may have any suitable configuration, shape, and/or dimensions. For example, the support elements may include one or more spaces or slots complementary in shape to a corresponding component. As shown in FIGS. 1-3, for example, the first support element 142 may have three spaces or slots 144, and the second support element 158 may have two spaces or slots 160. Similar to the caddy 124, discussed above, each slot 144, 160 may have a shape that generally matches the shape of a corresponding component. For example, slots 144 within the first support element 142 may have smaller, generally cylindrical shapes suitable for receiving the tips of the cartridge units 184, and slots 160 within the second support element 158 may have larger, generally cylindrical shapes suitable for receiving the tips of the battery units 182. The slots 144, 160 may extend the entire length of the support elements 142, 158 or only a portion thereof. In some embodiments, for example, the slots 144, 160 may terminate at a closed bottom portion of the support elements 142, 158.

The support element(s) may be attached or otherwise coupled to other guiding elements and/or surfaces of the base 102. For example, one or more support elements, e.g., the first support element 142, may be coupled to or disposed within a portion of the caddy 124, e.g., a lower portion of the caddy 124. Embodiments of the present disclosure may include any number of support elements, e.g., only one support element, or three or more support elements. In some embodiments, packages according to the present disclosure may not include any support elements.

The caddy 124 and/or support element(s) 142, 158 may be coupled to an attachment or fitting, e.g., to assist in supporting one or more components disposed within the support element(s). Attachments or fittings may have any suitable configuration, shape, and/or dimensions. As shown in FIG. 3, for example, the package 100 may include an attachment 132 having a recessed interior for receiving the first support element 142. The attachment 132 may be attached or otherwise coupled to the first support element 142 and/or the caddy 124 via any suitable material or mechanism. In some embodiments, the attachment 132 may extend along only a portion of the width of the caddy 124. As shown in FIG. 3, for example, the attachment 132 and first support element 142 may be generally aligned with three slots 126 of the caddy 124, leaving two longer slots 126 open adjacent to the attachment 132 and the first support element 142. Thus, shorter components (e.g., the cartridge units 184) may be disposed in the three shorter slots 126, and longer components (e.g., the battery units 182) may be disposed in the two longer slots 126. Other configurations of shorter and longer slots may be possible, such as a plurality of shorter slots disposed between longer slots. Further, while package 100 illustrates two different length of slots 126, in some embodiments, package 100 may include three slots 126 or more having three different lengths, e.g., depending on the particular configuration of the base 102 and the guiding elements within the base 102.

The attachment 132 may be configured to accommodate one or more other portions of package 100 and/or components within package 100. For example, the attachment 132 may include an upper stepped portion generally aligned with the hinge component 108, and/or a projection 134 extending below to accommodate other items, such as a power adapter 170. In at least one embodiment, the projection 134 may be complementary in shape to the power adapter 170. As shown in FIG. 3, for example, the projection 134 may include a surface feature such as a groove for receiving a USB connector 172 of the power adapter 170 to protect and/or limit movement of the power adapter 170 within package 100.

In some embodiments, package 100 also may include a fitting 154 coupled to the second support element 158. The fitting 154 may assist in supporting the tip of the battery unit 182 (thus supporting the electronic cigarette 180 assembled from the battery unit 182 and the cartridge unit 184). In some embodiments, the fitting 154 may be attached to the bottom 103 of the package 100, and the upper surface of the fitting 154 may be attached or otherwise coupled to the second support element 158. Similar to the attachment 132, the fitting 154 may be configured to accommodate one or more portions of package 100 and/or components within package 100. For example, the fitting 154 may include features complementary to a door 164 in the bottom 103 of the base 102, as discussed below. In some embodiments, the fitting 154 may help to guide movement of the door 164 as it opens and closes, and/or may help to lock the door 164 in place when closed.

Each of the guiding elements (e.g., caddy 124, support elements 142, 158, attachment 132, and/or fitting 154) may be coupled within the base 102 via any suitable mechanism and/or material, including, but not limited to, the mechanisms and/or materials discussed above for securing the hinge assembly 108 to the base 102. In some embodiments, a portion of one or more guiding elements may be integral with the base 102 and/or integral with another guiding element. For example, a portion of the caddy 124 may be integral with the first support element 142 and/or the attachment 132.

Compartment

Package 100 may include one or more compartments 171 for housing different items. For example, the compartment 171 may house a power source, charger, or adapter 170 for recharging one or more components of the vaporizing device. An exemplary power adapter 170 is shown in FIGS. 1 and 2 having two types of connectors, a first connector 172 (e.g., a USB connector) compatible with a power source, and a second connector 174 compatible with one or more components of the vaporizing device (e.g., a connector compatible with the battery unit 182). The power adapter 170 thus may be used to recharge the vaporizing device as needed, e.g., by inserting the second connector 174 into the battery unit 182, and plugging in the first connector 172 to a compatible power source such as a USB-compatible outlet or computer port. In some embodiments, the power adapter 170 may also serve as a communications device or adapter (or package 100 may include a separate communications device or adapter), e.g., configured to transfer, transmit, store, and/or analyze data from the vaporizing device. For example, the power adapter 170 may be configured to transfer data regarding usage characteristics of the vaporizing device and/or the operating status of one or more components of the vaporizing device to a computer or other electronic device. Any data of a vaporizing device, associated features of the vaporizing device, and methods of data transfer and storage disclosed in U.S. Provisional Application No. 61/971,340, filed Mar. 27, 2014, and/or U.S. Provisional Application No. 61/847,364, filed Jul. 17, 2013, each incorporated by reference herein, may be used according to the present disclosure. The compartment 171 may be used for housing other items, such as replacement components of the vaporizing device, e.g., mouthpieces, liquid refill containers, vaporization units or attachments, heating units or attachments, sensors or sensor attachments, and/or lights or lighting attachments, among other possible items.

Figure 4B:
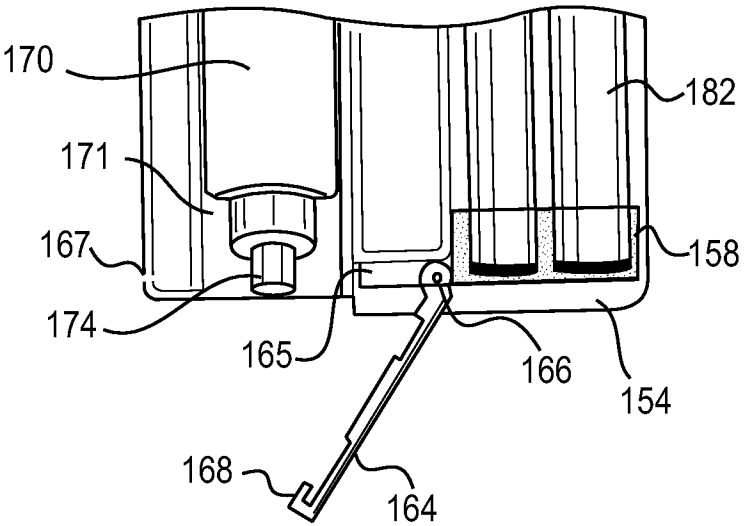
FIGS. 4A and 4B show a bottom portion of an exemplary package, in accordance with one or more embodiments of the present disclosure.
Figure 4A:
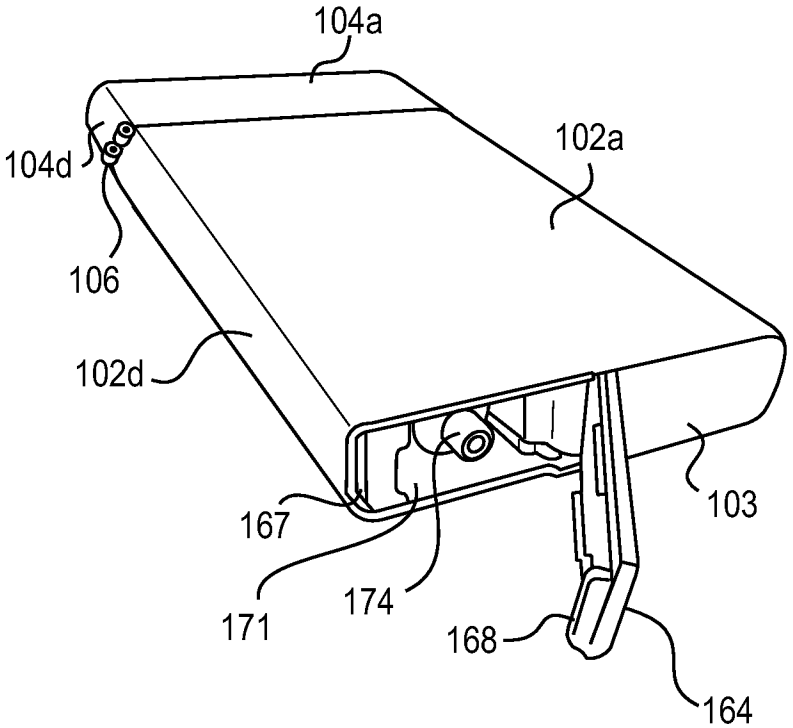

The compartment 171 may comprise a slot in the base 102 accessible via a door 164 as mentioned above. With reference to FIGS. 4A and 4B, for example, the compartment 171 may be located in a bottom portion of the base 102, below the caddy 124, such that the door 164 forms part of the bottom 103 of the base 102. In some embodiments, the door 164 may be adjacent to the fitting 154, wherein the fitting 154 may include a mating element complementary to a mating element of the door 164 to lock or otherwise secure the door 164 to the base 102. Exemplary mating elements include, but are not limited to, complementary male/female connections. Any other suitable locking mechanisms known in the art may be used. In some embodiments, the fitting 154 may provide a slot 165 for guiding movement of the door 164 for opening and closing the door 164. For example, the door 124 may include a first end 166 and a second end 168, wherein the first end 166 may be configured to slide within the slot 165, along the width of package 100, and the second end 168 may be configured to lock the door 164 to the base 102. As shown in FIG. 4B, the first end 166 may allow the door 164 to pivot with respect to the bottom 103 of the base 102, e.g., the first end 166 defining a pivot axis. The second end 168 may include a lip that may latch the door 164 to the side wall 102*d* to secure the door 164 to the base 102, e.g., by inserting the lip into a space 167 defined by the side wall 102*d*. The door 164 thus may be opened by sliding the door 164 within the slot 165 to unlatch the lip from the side wall 102*d*, and then pivoting the door 164 outward to access the compartment 171.

Other configurations for the door 164 and/or mechanisms for opening, closing, locking, and/or unlocking the door 164 may be used. In some embodiments, for example, the door 164 may be configured to unlatch from the base 102 without sliding, e.g., via mating elements of the door 164 and the bottom 103 of the base 102. Further, the door 164 may be positioned at any other suitable location along the base 102, depending on the location of the compartment 171. For example, the door 164 may be located at the other side of the bottom 103 (e.g., adjacent to the first side wall 102*c* rather than the second side wall 102*d*), or along one of the side walls 102*c*, 102*d* rather than along the bottom 103.

Labeling

One or more external surfaces of the base 102 and/or the cover 104 may include any suitable labeling or other indicia, as desired. For example, package 100 may include one or more labels showing, e.g., depictions of a vaporizing device or other contents of package 100, a company logo, slogans, catch-phrases, or other advertising or promotional materials. As shown in FIG. 3, for example, at least a portion of each of the base 102 and the cover 104 may include labels 188, 190, respectively. In some embodiments, only portions of the base 102 and/or cover 104 may include labeling. For example, the base 102 and/or the cover 104 may be at least partially transparent such that items inside of the package 100 not covered by the labels 188, 190 may be visible.

Figure 5:
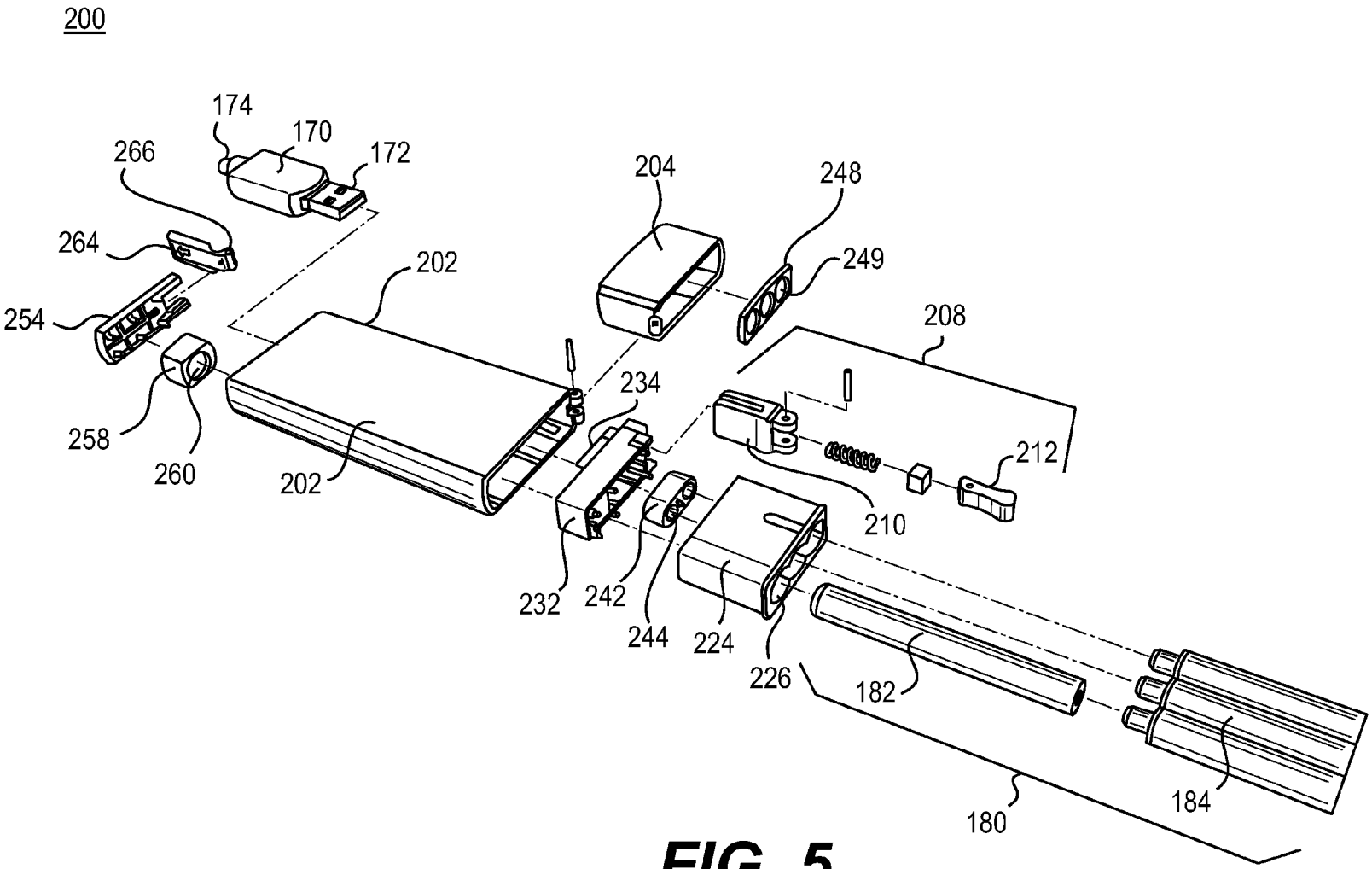
FIG. 5 shows an exploded view of an exemplary package, in accordance with one or more embodiments of the present disclosure.

FIG. 5 shows another exemplary package 200 having a relatively smaller size in comparison to package 100. In particular, package 200 may have generally the same length and depth dimensions as package 100, but a narrower width dimension. Package 200 thus may have relatively less space along the width of the base 202 for housing different or fewer components, providing for a more compact package size.

Package 200 may include any of the features and combinations of features of package 100 discussed above, adapted in some cases for the narrower width. For example, package 200 includes a base 202 and a cover 204 similar to the base 102 and cover 104, respectively, of package 100, but each having a narrower width. Package 200 may include a hinge assembly 208 having a segment 210 and a lever 212. As shown in FIG. 5, the base 202 may include a caddy 224 similar to caddy 124 of package 100, but having three slots 226 instead of five, e.g., for housing an electronic cigarette 180 and two cartridge units 184. The base 202 also may include a first support element 242 similar to the first support element 142 of package 100, but having two slots 244 instead of three, and a second support element 258 similar to second support element 158 of package 100, but having one slot 260 instead of two. The base 202 also may include an attachment 232 and a fitting 254 similar to the attachment 132 and fitting 154, respectively, of package 100, but adapted for the narrower width of package 200. The cover 204 may include a fixture 248 similar to the fixture 148 of package 100, but having three recessed spaces 249 for receiving components instead of five. The configuration of package 200 may provide a longer slot for receiving an electronic cigarette 180 (e.g., comprising a battery unit 182 and a cartridge unit 184), and two shorter slots for receiving two cartridge units 184. Certain other features of package 200 may be generally the same in size and shape as corresponding features of package 100, such as a projection 234 of the attachment 232 for receiving a portion of the power adapter 170, and a door 264 in the base 202 (the door 264 having end 266) for accessing the power adapter 170 or other items.

Any features of a package disclosed herein may be combined with any other features. For example, while FIGS. 1-5 illustrate particular combinations of guiding elements, packages according to the present disclosure may include only one or several of those elements, such as only a caddy 124, only support elements 142, 158, a combination of a caddy 124 and an attachment 132, or a combination of a caddy 124 and a support element 158, among other possible combinations.

While principles of the present disclosure are described herein with reference to illustrative embodiments for particular applications, it should be understood that the disclosure is not limited thereto. Those having ordinary skill in the art and access to the teachings provided herein will recognize additional modifications, applications, embodiments, and substitution of equivalents all fall within the scope of the embodiments described herein. Thus, other variations in the size, features, and dimensions of different elements will be apparent to the skilled artisan in accordance with the disclosure provided herein. Accordingly, the invention is not to be considered as limited by the foregoing description.

What is claimed is:

1. A package comprising:
a base;
a cover movably coupled to the base for opening and closing the package;
a caddy disposed within the base and extending along only a portion of a length of the base; and
a second support element coupled to a bottom portion of the base, the second caddy element configured to receive at least one end portion of a component of an electronic vaporizing device;
wherein the package includes a plurality of slots extending along the length of the base and at least partially through the caddy for receiving a plurality of components of the electronic vaporizing device, at least one of the slots having a length different from a length of another one of the slots.

2. The package of claim 1, wherein the base includes at least one slot extending a substantially entire length of the base.

3. The package of claim 1, wherein the caddy is coupled to an upper portion of the base.

4. The package of claim 1, wherein the caddy includes at least three slots, at least two of the slots having the same length.

5. The package of claim 4, wherein the caddy includes five slots.

6. The package of claim 1, further comprising a first support element coupled to a lower portion of the first guiding element.

7. The package of claim 6, wherein the first support element is configured to seal an opening in a component of the electronic vaporizing device.

8. The package of claim 1, further comprising the plurality of components of the electronic vaporizing device.

9. The package of claim 8, wherein the plurality of components of the electronic vaporizing device includes at least one of a battery unit and a cartridge unit.

10. The package of claim 1, further comprising a compartment at least partially separated from the plurality of slots.

11. The package of claim 10, wherein the compartment includes a power adapter.

12. A package comprising:
a base;
a cover pivotally attached to the base for opening and closing the package;
a caddy disposed within the base and extending along only a portion of a length of the base;
a first support element coupled to the caddy; and
at least one electronic cigarette;
wherein the package includes a plurality of slots extending along the length of the base and at least partially through the caddy, the plurality of slots comprising a first slot including the electronic cigarette and a second slot having a length different from a length of the first slot;
wherein the first support element defines a closed end of the second slot.

13. The package of claim 12, further comprising at least one replacement component of the electronic cigarette disposed in the second slot.

14. The package of claim 13, wherein the at least one replacement component includes a cartridge unit.

15. A package comprising:
a base including a bottom wall and an open top, wherein the bottom wall includes a door;
a cover pivotally attached to the base for opening and closing the package; and
at least one guiding element;
wherein the package includes a plurality of slots extending along a length of the base for receiving a plurality of components of an electronic vaporizing device, the plurality of slots including a first slot open to the cover and closed to the bottom wall of the base, and a second slot being open to the door of the bottom wall of the base and closed to the cover;
wherein the first slot at least partially extends through the at least one guiding element.

16. The package of claim 15, wherein the second slot comprises a compartment adjacent to the first slot.

17. The package of claim 15, wherein the first slot extends from the bottom wall to the open top.

* * * * *